United States Patent [19]

Fier

[11] 4,225,266

[45] Sep. 30, 1980

[54] METHOD AND APPARATUS FOR ADJUSTING THE ELEVATION OF MANHOLE COVERS

[76] Inventor: Raymond L. Fier, 5323 Pin Oak Ave. NW., Massillon, Ohio 44646

[21] Appl. No.: 956,623

[22] Filed: Nov. 1, 1978

[51] Int. Cl.[2] ..... E02D 29/14; E01C 23/00

[52] U.S. Cl. ..... 404/26; 404/72; 52/20; 210/164

[58] Field of Search ..... 404/72, 26, 25; 52/19, 52/20, 21; 210/164, 163

[56] References Cited

U.S. PATENT DOCUMENTS

| | | | |
|---|---|---|---|
| 1,517,871 | 12/1924 | Thompson | 404/26 |
| 2,346,361 | 4/1944 | Cupido | 404/26 |
| 3,218,943 | 11/1965 | Bowman | 404/26 |
| 3,773,428 | 11/1973 | Bowman | 404/26 |
| 3,891,337 | 6/1975 | McCoy | 404/26 |
| 4,097,171 | 6/1978 | Fier | 404/26 |

FOREIGN PATENT DOCUMENTS 394687 12/1965 Switzerland .

*Primary Examiner*—Nile C. Byers, Jr.
*Attorney, Agent, or Firm*—Frease & Bishop

[57] ABSTRACT

A manhole cover elevating and support ring adapted to be placed within an existing manhole frame for raising the height of a manhole cover, and a method of installing the same. A circular ring is roll formed of metal bar stock with a predetermined size gap. An improved adjustable link is force-fitted within the ring gap to expand the ring outwardly into abutting clamping engagement with an annular wall of a manhole frame to securely mount the ring therein. The improved method includes the steps of radially compressing the ring and restraining the ring in this compressed position. The ring then is placed within a manhole frame opening. The restraining means is removed and the ring expands outwardly toward its normal uncompressed position, thereby clamping itself tightly against the manhole frame. The improved adjustable link and a spring biased keeper also may be installed within the ring gap to insure its clamping engagement with the manhole frame.

15 Claims, 12 Drawing Figures

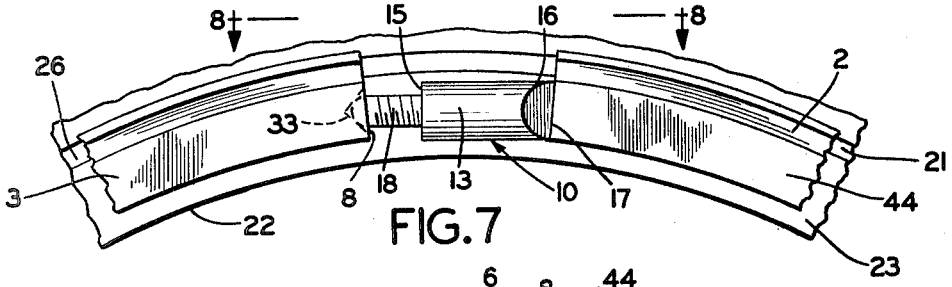
FIG.7
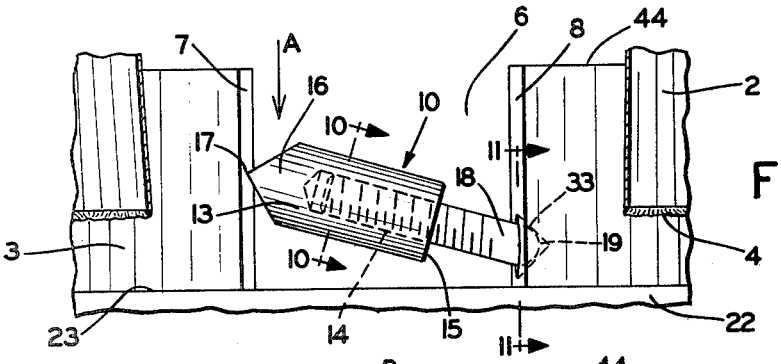
FIG.8
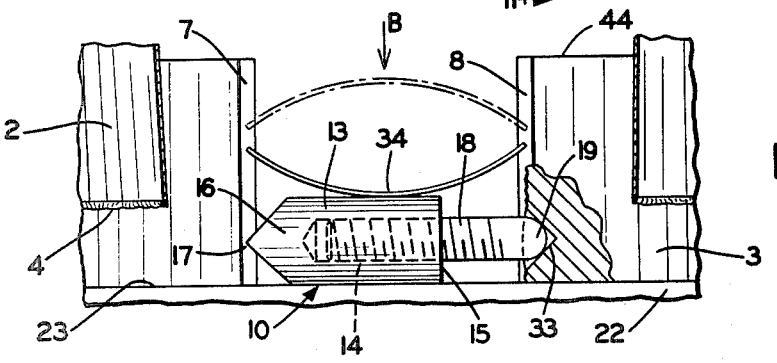
FIG.9
FIG.10
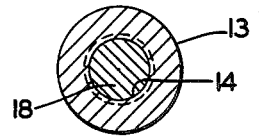
FIG.11
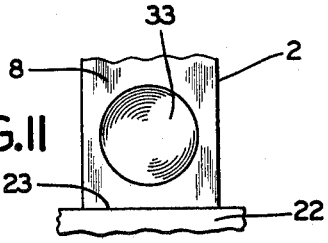
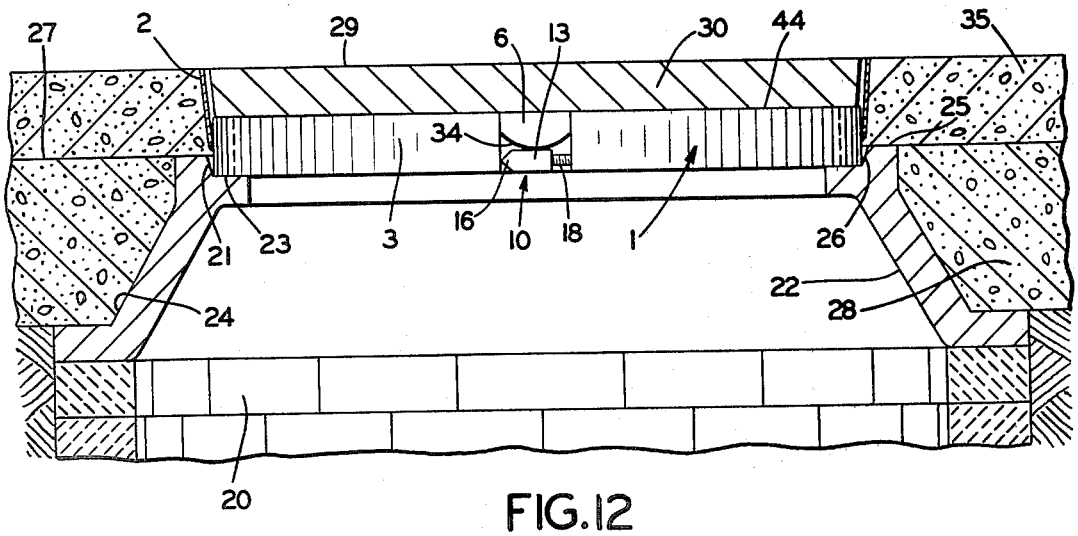
FIG.12

METHOD AND APPARATUS FOR ADJUSTING THE ELEVATION OF MANHOLE COVERS

BACKGROUND OF THE INVENTION

1. Field of the Invention

The invention relates to manhole cover supports and, in particular, to a separate ring placed within an existing manhole frame to raise the height of the manhole cover to compensate for added roadway pavement. More particularly, the invention relates to an improved method for installing the ring in the manhole frame.

2. Description of the Prior Art

Most underground facilities such as sanitary and storm sewers, utility conduits and the like have manhole openings to provide access thereto. These manholes usually are located in the street or roadway and consist of an inverted bell-shaped metal frame mounted on top of a brick or concrete base structure. This metal frame has an internal ledge for supporting the manhole cover so that the top of the cover is level with the top of the frame and surrounding roadway pavement.

Problems arise quite frequently in the resurfacing of roadways in that a layer of pavement is placed on the existing pavement, resulting in the manhole cover being below the top surface of the new pavement causing a depression in the roadway. It is quite difficult and expensive to raise the existing manhole frame sufficiently to compensate for the added pavement.

Various devices and methods have been constructed and used which enable an existing manhole cover to be raised to the level of the new pavement surface without raising the existing manhole frame. Examples of these devices and methods are shown in U.S. Pat. Nos. 1,517,871, 3,218,943, 3,773,428, and 3,891,337.

Some of these prior art devices, although apparently providing the desired results, are expensive to manufacture due to the number of machining and forming operations required for their fabrication. Likewise, these devices achieve their adjustment and/or clamping engagement with the manhole frame by a threaded screw mechanism or inclined, frictionally retained wedge which in time may become loose due to the continuous vibration caused by passing vehicles. These screw mechanisms and wedges become corroded, preventing removal of the elevating ring should their removal be required in the future. Also, most known devices use an expanding mechanism which protrudes into the I.D. of the manhole, thereby reducing the actual I.D. as well as creating a work and safety hazard for workmen climbing into and out of the manhole opening.

Many of the problems encountered with these known constructions and devices are believed to be overcome by the manhole cover support ring shown in my earlier U.S. Pat. No. 4,097,171. Use of the manhole cover elevating and support ring of U.S. Pat. No. 4,097,171 in actual field installations indicates that the construction is performing quite satisfactorily.

However, it is important for nearly all manufacturers to be able to provide their products at as low a cost as possible without sacrificing quality. The present invention provides an elevating ring construction and a method of installing the same in a manhole frame which reduces the cost of my previously patented support ring while providing the same satisfactory results. This reduction in cost is achieved by eliminating the toggle mechanism and the mounting of this mechanism on the elevating ring so it functions as an integral part of the ring construction. Cost reduction also is achieved during installation by eliminating some of the operations which may be required to be performed on the ring in the field by the workmen.

No known manhole cover elevating and support ring and method of installing the same of which I am aware uses the natural elasticity in a compressed split metal ring to clamp the ring within the manhole cover frame, or uses a separate adjustable link that is force-fitted within a gap formed in the split ring, alone or in combination with the elasticity of the compressed ring, to clamp the ring in the frame opening.

SUMMARY OF THE INVENTION

Objectives of the invention include providing an apparatus for adjusting the elevation of manhole covers within a manhole frame opening by providing a ring formed relatively inexpensively of a flat strip of metal rolled circular and a strip of rectangular bar stock rolled circular which are welded together with a predetermined sized gap existing between the adjacent spaced ends of the ring, and in which the metal ring possesses sufficient natural elasticity that after being partially compressed and placed within a manhole frame opening will expand outwardly against the sides of an existing manhole frame opening with sufficient force to become firmly seated therein, or in which an extremely inexpensive and simple adjustable link is force-fitted between the spaced ends of the ring by a hammer or similar tool to install the ring in the frame opening; providing such an apparatus in which the ring can be removed from the frame opening by loosening the force-fit engagement of the link with the spaced ring ends by shortening the length of the link by a simple rotation of one of the link components by use of a pliers or similar tool; providing such an apparatus in which a keeper formed by an inexpensive strip of spring metal is placed between the spaced ends of the ring in a bowed engagement with the installed link to further insure retention of the link in engagement with the spaced ends of the ring; providing such a mechanism in which the link is easily adjusted to regulate the limits of outward expansion of the ring so as to compensate for and accommodate various sizes of openings in manhole covers and irregularities of roundness in both the frame opening and elevating ring; providing such an apparatus in which the adjustable link provides a high mechanical advantage and a positive force-fit engagement with the elevating ring which adjusts the ring to minor manhole variations in the field and which cannot be readily loosened by vehicle-caused vibrations which is a problem with a frictionally held wedge-fit engagement; providing such an apparatus in which the link lies within the periphery of the elevating ring without any components protruding into the I.D. of the manhole frame opening, thereby eliminating a work hazard; and providing such an apparatus for elevating a manhole cover which is relatively inexpensive, which eliminates difficulties heretofore encountered with prior devices, achieves the stated objectives simply, effectively and efficiently, and solves problems and satisfies existing needs.

Further objectives of the invention include providing an improved method of adjusting the elevation of a manhole cover by initially roll forming an inexpensive elevating ring from metal stock into an annular configuration having a predetermined size gap between the spaced ends of the rolled strip, preferably at a location remote from the installation site; providing such an improved method in which the roll formed ring is radially compressed and retained in this compressed condition by restraining means such as an encircling banding strap or the like and is subsequently shipped to the job site and dropped into the manhole frame opening, whereupon the retaining band or other restraining means is removed and the ring expands outwardly into clamping engagement with the frame opening; providing such an improved method in which a manually adjustable link may be force-fitted within the gap of the split ring after its installation in a manhole frame opening to assist in forcibly expanding the ring outwardly into engagement with the frame opening, and in which a spring biased metal keeper strip also may be installed within the gap of the split ring to increase the reliability thereof by locking the link in the ring gap; and providing such an improved method which reduces the amount of work required to be performed at the job site, and which provides an extremely simple, inexpensive and effective method of adjusting the height of a manhole cover.

These objectives and advantages are obtained by the improved apparatus for adjusting the elevation of a manhole cover within a manhole frame, the general nature of which may be stated as including circular ring means having inwardly projecting manhole cover supporting ledge means and upstanding flange means, said ring means being split at least at one point on its periphery forming a gap between a pair of spaced end portions; adjustable link means adapted to be forcibly placed within the gap and extend between the spaced end portions of the ring means to expand the ring means outwardly forcing the flange means into abutting engagement with the manhole frame; the link means including a sleeve having inner and outer ends with an internally threaded axially extending opening communicating with the inner end, and a bolt threadedly engaged in said opening and extending axially therefrom; and the outer end of the sleeve and the bolt each engaging a respective spaced end of the ring means.

These objectives and advantages are further obtained by the improved method of adjusting the elevation of a manhole cover, the nature of which may be stated as including the steps of forming an annular elevating ring split at one point on its periphery to form a predetermined size gap between a pair of spaced end portions; radially compressing the split ring to move the end portions closer to each other; restraining the elevating ring in the compressed position; placing the restrained, compressed elevating ring within the circular opening of a manhole frame; removing the restraint on the elevating ring permitting the ring to expand outwardly toward its originally formed condition forcing the ring into abutting engagement with the manhole frame; installing an adjustable link in the gap between the spaced end portions with a force-fit to assist the outward expansion of the elevating ring; and installing a spring biased keeper between and operatively engageable with the spaced end portions to assist in maintaining the link in engagement with the spaced end portions.

BRIEF DESCRIPTION OF THE DRAWINGS

A preferred embodiment of the invention—illustrative of the best mode in which applicant has contemplated applying the principles—is set forth in the following description and shown in the accompanying drawings, and is particularly and distinctly pointed out and set forth in the appended claims.

FIG. 7 is a fragmentary top plan view showing the elevating ring in an expanded clamping position within the manhole frame opening with the adjustable link installed in the ring gap;

FIG. 8 is an enlarged fragmentary elevational view looking in the direction of arrows 8—8, FIG. 7, of the adjustable link when initially placed within the ring gap prior to moving the link to its installed locked position;

FIG. 9 is a fragmentary elevational view similar to FIG. 8 showing the adjustable link in installed position, with a spring biased keeper mounted in the ring gap to assist in retaining the link therein;

FIG. 10 is an enlarged sectional view taken on line 10—10, FIG. 8;

FIG. 11 is an enlarged fragmentary elevational view looking in the direction of arrows 11—11, FIG. 8; and FIG. 12 is a diagrammatic sectional view of the improved manhole cover elevating apparatus supporting a manhole cover on an existing manhole frame.

Similar numerals refer to similar parts throughout the drawings.

DESCRIPTION OF THE PREFERRED EMBODIMENT

Figure 1:
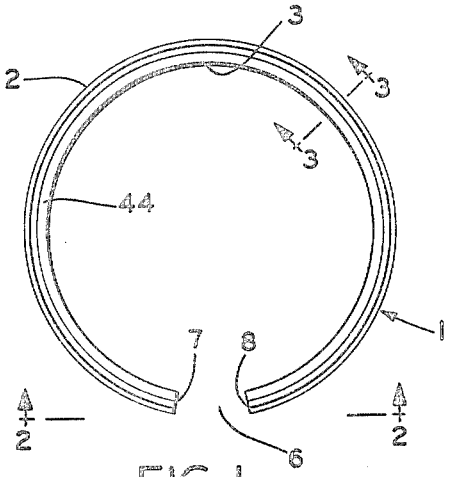
FIG. 1 is a top plan view of the elevating ring in its rolled, normal expanded condition.
Figure 2:
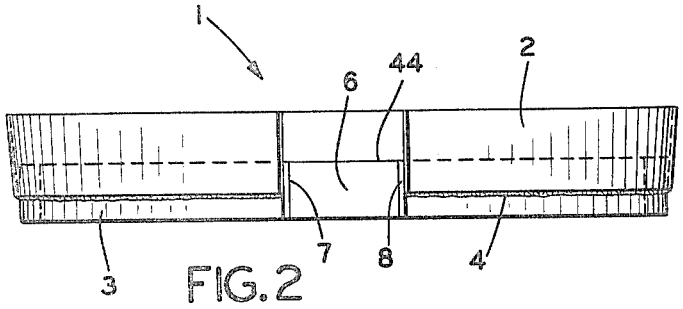
FIG. 2 is an enlarged front elevational view looking in the direction of arrows 2—2, FIG. 1.
Figure 3:
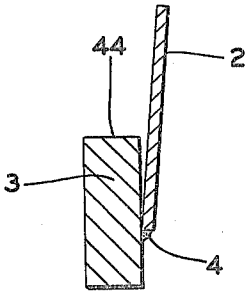
FIG. 3 is an enlarged sectional view taken on line 3—3, FIG. 1.

The improved apparatus for adjusting the elevation of a manhole cover is shown in the drawings and includes as a main component a manhole cover support and elevating ring, indicated generally at 1 (FIGS. 1, 2 and 3). Ring 1 includes a generally vertical flange 2 and a lower manhole cover support bar 3. Flange 2 is formed of a relatively flat metal strip with bar 3 being formed from bar stock, preferably having a rectangular cross-sectional configuration as shown in FIG. 3. Bar 3 is attached by welds 4 to the bottom portion of flange 2. Flange 2 and bar 3 are welded in a flat condition and then are formed into the circular configuration of FIG. 1. Bar 3 lies radially inwardly or inside of the periphery of flange 2 for supporting a manhole cover thereon.

Flange 2 and bar 3, when rolled into the circular configuration of ring 1, form a predetermined size gap 6 extending between a pair of spaced ring ends 7 and 8. In an example of ring 1 for a usual installation, bar 3 will be hot-rolled, low-carbon 1020 AISI steel, approximately ¾ of an inch thick and 2 inches high. Flange 2 will be formed of twelve gauge similar type steel and will extend upwardly beyond the top of bar 3 approximately 1 to 3 inches, the amount of which depends upon the particular thickness of the manhole covers to be inserted therein. For the example given above, ring 1 will have a diameter of approximately 24 inches, with gap 6 being approximately 4½ inches.

Manhole frames used by most cities and municipalities have predetermined size openings so that the required diameter of ring 1 is known at time of construction. In the event the particular manhole opening in which ring 1 will be used varies from a standard size, the diameter of the ring can be changed by varying the length of flange 2 and bar 3 prior to roll forming them into their circular configuration. Flange 2 when welded on bar 3 will extend slightly outwardly from a true vertical position at an angle of approximately 3°, as shown in FIG. 3, to form a frustro conical configuration in order to be complementary with the tapered sides provided on most manhole covers.

In accordance with one of the features of the invention, an adjustable link, indicated generally at 10 (FIGS. 7, 8 and 9), is used to expand ring 1 within the opening of a manhole frame, as shown in FIG. 12. Link 10 is formed by a tubular sleeve 13 having an internally threaded, axially extending central bore 14 which extends partially into sleeve 13 from inner sleeve end 15. Outer sleeve end 16 is formed with a chisel-like point 17. A threaded bolt 18 is adjustably engaged within bore 14 and has an outer rounded end 19.

FIG. 12 shows elevating ring 1 mounted in a manhole opening 21. A usual manhole consists of a bell-shaped frame 22 which is mounted on the top of a brick water catch basin 20. Frame 22 has an annular, horizontal manhole cover supporting ledge 23 which terminates in an upwardly, generally outwardly extending, conical wall 26. Wall 26 is connected with outer bell surface 24 by an annular horizontal top surface 25. The top surface 27 of the original road pavement 28 is generally level with top surface 25 of frame 22 and with top surface 29 of a manhole cover 30 when cover 30 is supported on horizontal ledge 23.

When installing ring 1, all dirt, rust and debris is removed from ledge 23 and conical wall 26 of manhole frame 22. Ring 1 then is placed within manhole opening 21, which is defined by frame wall 26, with adjustable link 10 being placed in gap 6, as shown in FIGS. 8, 9 and 10. Bolt end 19 is placed within a concave recess 33 formed in ring end portion 8 (FIG. 11). Link 10 then is moved from the position of FIG. 8 to that of FIG. 9 by several blows, such as by hammer, which are delivered in the direction of arrow A (FIG. 8). These blows pivot link 10 downwardly in a counterclockwise direction to the installed position of FIG. 9 expanding ring 1 outwardly and clamping it tightly against conical surface 26.

Chisel point 17, if sufficient force is applied to link 10, will cut into the metal of end wall portion 7 until reaching the installed position of FIG. 9, thereby locking it securely in this position. Considerable force can be applied by a hammer or the like to link 10, which force is distributed throughout ring 1, forcing it into a very tight clamping engagement with frame wall 26. Link 10 is manually adjusted prior to forcing it to its lower position by relative rotation between sleeve 13 and bolt 18. This adjustment enables ring 1 to be used for various manhole openings and to be able to compensate for minor ring variations encountered at the job site. This is especially important since ring 1 and manhole frame 22 are not machined parts and therefore will vary somewhat in dimensions.

Link 10 enables a very high mechanical advantage to be achieved which is not possible with many known elevating ring constructions. Also, no manual adjustment of bolts or other threaded expanders is required after the expanding member is under stress in order to achieve the clamping engagement as in prior constructions, since link 10 is adjusted prior to locking the same in gap 6.

Another secondary feature of the invention is the use of a keeper 34 (FIG. 9) to completely insure the retention of link 10 in its installed position to increase the reliability of the improved manhole cover elevating apparatus. Keeper 34 is a short flat strip of spring metal which can be cut in the field and inserted in gap 6, as shown in FIG. 9, with its ends engaging end wall portions 7 and 8. Keeper 34 is pressed downwardly (arrow B, FIG. 10) against link 10 forming a concavely bowed, biased configuration. Once keeper 34 is installed in this bowed position, considerable force would be required to move keeper 34 upwardly and out of engagement with link 10. Keeper 34 reduces the possibility of vehicle vibrations slowly but continuously moving link 10 upwardly since these vibrational forces are too low to overcome the bias of keeper 34.

After link 10 is driven from the position of FIG. 8 to that of FIG. 9 and keeper 34 installed, cover 30 is placed on top surface 44 of bar 3 in a usual manner with its top surface 29 being generally level with the top surface of new pavement layer 35. If desired, a gasket (not shown) may be placed between manhole 30 and bar surface 44 to reduce metal-to-metal contact noise when driven over by a vehicle.

In further accordance with the invention, the improved method of installing elevating ring 1 is shown generally in FIGS. 1–6. The initial step of this method includes the roll-forming of welded bar members 2 and 3 into the circular, split ring configuration of FIG. 1. Ring 1 will have a predetermined diameter and gap 6, depending upon the particular size of the manhole opening in which it is to be installed. The O.D. of ring 1, however, will be larger than the inside diameter of manhole opening 21 defined by frame wall 26.

Figure 4:
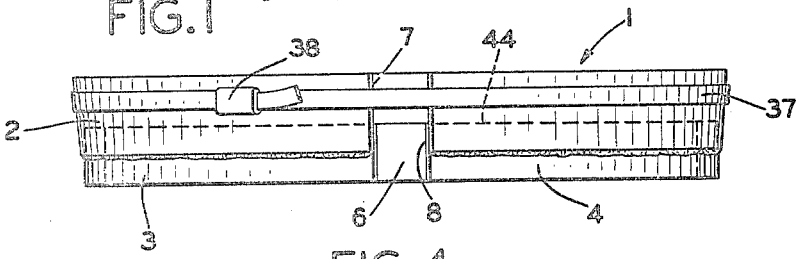
FIG. 4 is a view similar to FIG. 2 showing the elevating ring in a compressed, restrained position.

The next step of the improved method consists of compressing ring 1 by some means to partially close gap 6. After ring 1 is compressed, a band 37 or other restraining means, maintains ring 1 in the compressed state. This is particularly illustrated in FIGS. 2 and 4 wherein ring 1 is shown in FIG. 2 in its rolled, normal position with gap 6 having a predetermined size, which is considerably reduced when compressed, as shown in FIG. 4. Band 37 may be a usual steel strap connected by a clamp 38.

Figure 5:
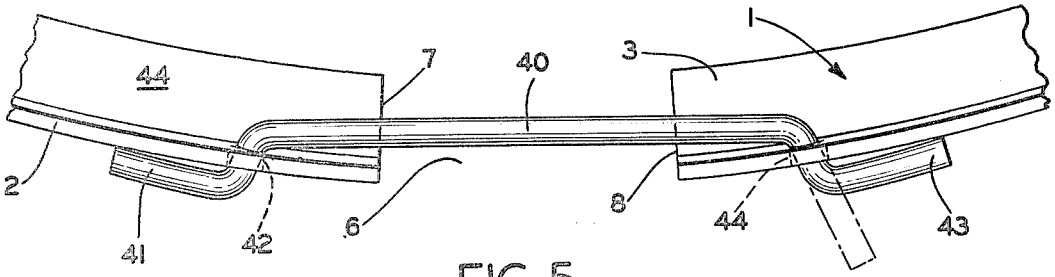
FIG. 5 is a greatly enlarged fragmentary top plan view showing a modified means of restraining the elevating ring in a compressed condition.

FIG. 5 shows another means of retaining ring 1 in a compressed state. A short section of rigid wire 40, one end of which is formed with an offset 41, is inserted through an opening 42 formed in flange 2. Opposite angled end 43 is inserted through an opposite side opening 44, whereafter wire end 43 is bent downwardly against ring 1 from the dot-dash line position to the full line position of FIG. 5, retaining ring 1 in its compressed condition.

The above operations preferably are performed at a location generally remote from the job site, preferably at the manufacturer's premises. These restrained, compressed elevating rings then are shipped to a job site for installation.

Figure 6:
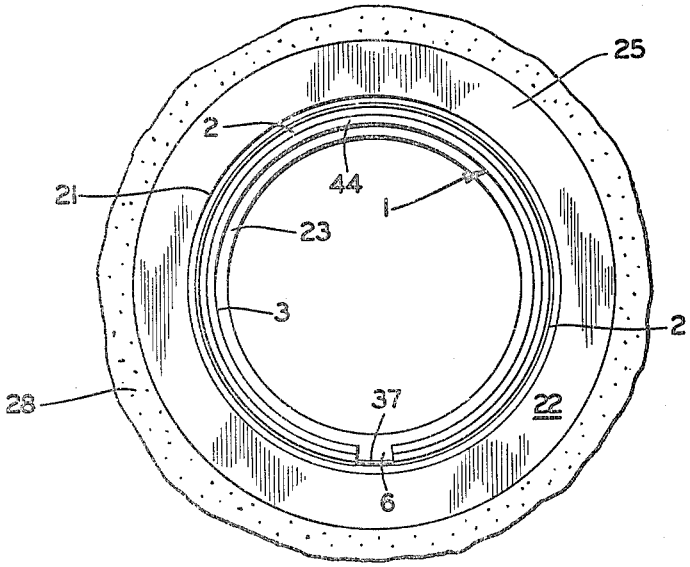
FIG. 6 is a top plan view showing the compressed, restrained elevating ring of FIG. 4 placed within a circular manhole frame opening.

FIG. 6 shows generally diagrammatically the next step of the improved method. Compressed ring 1, the O.D. of which has been reduced to an amount less than the I.D. of manhole opening 21, is placed within opening 21 upon horizontal frame ledge 23. Band 37 or wire 40 then is cut by a usual tool, whereupon the natural elasticity in the compressed ring metal will expand the ring outwardly attempting to return it to its natural "at rest" configuration of FIG. 1. This elasticity will tightly clamp the ring against frame surface 26. Thus, at a job site, the workmen only need to lower ring 1 onto cover support ledge 23 of a manhole frame and then break or cut band 37, whereupon ring 1 automatically clamps itself in position.

For a typical installation, ring 1 may have a diameter of 24 inches with gap 6 being approximately 4½ inches. This gap distance is compressed to approximately 2 inches (FIG. 4) and is so designed so that after release of the restraining means it will expand to a gap of approximately 2½ inches. Thus, it is easily understood that a considerable outward expansion force is continuously exerted by the ring against the manhole frame in attempting to return to its natural, prestressed position.

For many installations, no additional components or equipment will be required in that the expansion force exerted by the ring itself will be sufficient to retain ring 1 in installed position, whereupon manhole cover 30 is placed upon and supported by top surface 44 of ring bar 3.

It may be preferable for certain installations that a secondary locking means be used with expanded ring 1 to insure its mounting within the manhole frame. Link 10, the construction and use of which is described above, preferably is inserted in gap 6 to completely lock ring 1 in clamping position. Keeper 34 then may be installed in gap 6 to completely insure link 10 remaining in position.

Accordingly, the improved manhole cover elevating apparatus and method of installing the same provides a construction which is formed of a few relatively inexpensive and readily available components which are assembled by usual hand tools; provides a construction in which the compressed ring may have sufficient force to maintain itself in an installed position without requiring any additional retaining or locking components, and even if used with additional locking components, the resulting structure will not reduce the effective I.D. of the manhole opening nor require time-consuming expanding procedures, such as expanding the ring by tightening bolts or similar operations used by prior constructions; and provides a construction and method which is simplified, effective and safe in operation, which eliminates difficulties existing in the art, and which achieves the stated objectives and solves problems which have existed in the art.

In the foregoing description, certain terms have been used for brevity, clearness and understanding but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details of the construction shown or described.

Having now described the features, discoveries and principles of the invention, the manner in which the improved method and apparatus for adjusting the elevation of manhole covers is assembled and operated, the characteristics of the new method and construction, and the advantageous, new and useful results obtained; the new and useful structures, devices, elements, arrangements, parts, method steps, and combinations thereof are set forth in the appended claims.

I claim:

1. A method of raising the elevation of a circular manhole cover relative to a manhole frame when a new road surface layer is to be laid around the frame, in which the manhole frame has a circular opening for receiving a cover therein, including the steps of:

(a) forming an annular elevating ring split at one point on its periphery to form a gap between a pair of spaced end portions;

(b) radially compressing the split elevating ring to move the end portions closer to each other reducing the gap;

(c) restraining the elevating ring in the compressed position;

(d) placing the restrained, compressed elevating ring within a circular opening of a manhole frame; and (e) removing the restraint on the elevating ring permitting the ring to expand outwardly toward its originally formed condition forcing the ring into abutting engagement with the manhole frame.

2. The method set forth in claim 1 including the step of installing an adjustable link in the gap between the spaced end portions of the elevating ring with a force-fit to assist the outward expansion of the elevating ring to increase the abutting engagement of the ring with the manhole frame.

3. The method set forth in claim 2 including the step of installing a spring biased keeper between and operatively engaged with the spaced end portions of the elevating ring to assist in maintaining the link in abutting engagement with the spaced end portions.

4. The method set forth in claim 2 including the step of forming a recess in one of the spaced end portions of the ring for receiving an end of the adjustable link therein.

5. The method set forth in claim 1 in which the ring restraining step includes placing and tightening a metal band circumferentially about the elevating ring.

6. The method set forth in claim 1 in which the compressing and restraining steps include moving the spaced end portions of the elevating ring closer together and placing metal strap means through openings formed in the spaced end portions of the ring to maintain said end portions in the compressed condition.

7. The method set forth in claim 2 in which the adjustable link is placed generally diagonally in the gap extending between the spaced end portion and then driven vertically downwardly to a generally horizontal position for expanding the ring outwardly.

8. A method of raising the elevation of a circular manhole cover relative to a manhole frame, in which the manhole frame has a circular opening for receiving a cover therein, including the steps of:

(a) forming an annular elevating ring split at one point on its periphery to form a predetermined size gap between a pair of spaced end portions of the ring;

(b) placing the elevating ring within the circular opening of a manhole frame;

(c) placing an adjustable link at an inclined position in the gap between the spaced end portions of the ring and in engagement with said end portions;

(d) forcing the adjustable link vertically downwardly from an inclined position to a generally horizontal position to expand the ring outwardly, forcing the ring into abutting clamping engagement with the manhole frame; and (e) installing a spring-biased keeper between the spaced end portions of the ring to assist in maintaining the link in position between said spaced end portions.

9. The method set forth in claim 8 including the step of forming a recess in one of the spaced end portions of the ring for receiving an end of the adjustable link therein.

10. The method set forth in claim 8 in which the link is struck manually by a blunt instrument to move it from an inclined position to a horizontal position.

11. A method of raising the elevation of a circular manhole cover relative to a manhole frame, in which the manhole frame has a circular opening for receiving a cover therein, including the steps of:

(a) forming an annular elevating ring split at one point on its periphery to form a predetermined size gap between a pair of spaced end portions of the ring;
(b) applying restraining means on the split ring to radially compress said ring;
(c) placing the compressed elevating ring within the circular opening of a manhole frame;
(d) removing the restraining means permitting the ring to expand outwardly into abutting engagement with the manhole frame;
(e) placing an adjustable link at an inclined position in the gap between the spaced end portions of the ring and in engagement with said end portions; and
(f) forcing the adjustable link vertically downwardly from an inclined position to a generally horizontal position, forcing the ring into abutting clamping engagement with the manhole frame.

12. Apparatus for adjusting the elevation of a manhole cover within a manhole frame including:

(a) circular ring means having inwardly projecting manhole cover supporting ledge means and upstanding flange means, said ring means being split at least at one point on its periphery forming a gap between a pair of spaced end portions;
(b) a recess formed in one of the spaced end portions of the ring means;
(c) adjustable link means adapted to be forcibly placed within the gap and extend between the spaced end portions of the ring means to expand the ring means outwardly to force the ring means into abutting engagement with the manhole frame;
(d) the link means including a sleeve having inner and outer ends with said outer end being formed with a chisel-like point and with an internally threaded, axially extending opening being formed in the sleeve and communicating with the inner end, and a bolt threadably engaged in said opening and extending axially therefrom, said bolt having a rounded outer end adapted to be removably seated within the recess of said one spaced end portion of the ring means; and
(e) the outer end of the sleeve and the bolt each engaging a respective spaced end of the ring means.

13. Apparatus for adjusting the elevation of a manhole cover within a manhole frame including:

(a) circular ring means having inwardly projecting manhole cover supporting ledge means and upstanding flange means, said ring means being split at least at one point on its periphery forming a gap between a pair of spaced end portions;
(b) adjustable link means adapted to be forcibly placed within the gap and extend between the spaced end portions of the ring means to expand the ring means outwardly to force the ring means into abutting engagement with the manhole frame;
(c) the link means including a sleeve having inner and outer ends with an internally threaded axially extending opening communicating with the inner end, and a bolt threadably engaged in said opening and extending axially therefrom;
(d) the outer end of the sleeve and the bolt each engaging a respective spaced end of the ring means; and
(e) spring-biased keeper means operatively engaged with the spaced end portions of the ring means and link means to assist in maintaining said link means between said spaced end portions.

14. The apparatus defined in claim 13 in which the keeper is a strip of flexible spring metal having a pair of ends and being longer in length than the gap between the spaced end portions of the ring means; and in which the keeper assumes a downwardly bowed concave shape with the strip ends engaging the spaced end portions of the ring means to maintain the link means in position.

15. The apparatus defined in claim 13 in which the sleeve has a cylindrical configuration.

* * * * *